United States Patent [19]

Hayashi

[11] Patent Number: 4,470,282

[45] Date of Patent: Sep. 11, 1984

[54] METHOD OF PIERCING IN SEAMLESS TUBE MANUFACTURING

[75] Inventor: Chihiro Hayashi, Amagasaki, Japan

[73] Assignee: Sumitomo Kinzoku Kogyo Kabushiki Gaisha, Osaka, Japan

[21] Appl. No.: 338,631

[22] Filed: Jan. 11, 1982

[30] Foreign Application Priority Data

Apr. 10, 1981 [JP] Japan ..... 56-54735

[51] Int. Cl.[3] ..... B21B 19/04

[52] U.S. Cl. ..... 72/97; 72/100

[58] Field of Search ..... 72/96, 97, 100

[56] References Cited

U.S. PATENT DOCUMENTS

| | | | |
|---|---|---|---|
| 1,870,209 | 8/1932 | Diescher | 72/96 |
| 2,340,517 | 2/1944 | Diescher | 72/96 |
| 3,719,066 | 3/1973 | Okamoto et al. | 72/97 |

*Primary Examiner*—Lowell A. Larson

*Attorney, Agent, or Firm*—Darby & Darby

[57] ABSTRACT

The invention relates to a method of rotary piercing in seamless tube manufacturing under a rotary piercing process, such as Mannesmann mandrel mill process. Rotary piercing operation is carried out by employing a rotary piercing mill having a pair of cone-shaped main rolls adapted to cooperate with a plug for rotary piercing and disc rolls disposed in opposed relation between the pair of main rolls and adapted to press hollow shell on the surface thereof. In this method of rotary piercing, the main rolls have feed and cross angles designed to meet certain conditions individually and in combination. The method makes it possible to carry out rotary piercing of less hot workable and/or extremely hard-to-work materials, that is, high-alloy steel billets, without surface torsional deformation and circumferential shear deformation. Thus, it is possible to manufacture high quality tubes of high-alloy steels free from outside seams and inside bore defects.

11 Claims, 11 Drawing Figures

METHOD OF PIERCING IN SEAMLESS TUBE MANUFACTURING

BACKGROUND OF THE INVENTION (1) Field of the Invention

The present invention relates to a method of rotary piercing in seamless tube manufacturing operation by a rotary piercing process.

(2) Description of the Prior Art

The rotary piercing process (Mannesmann proces) is widely used in the manufacture of seamless steel tubes. The process comprises steps of passing billet heated to the prescribed temperatures through a rotary piercer to make them into hollow shell, rolling the hollow shell by mean of an elongator, e.g. plug mill or mandrel mill, to the desired wall thickness, and subjecting the rolled hollow shell to outside diameter sizing by means of a sizer or reducer to obtain finished tubes having the specified outside diameter (or wall thickness).

Since the present invention is directed to only the first one of these steps, namely, rotary piercing, the method of rotary piercing conventionally employed in seamless tube manufacturing is reviewed in detail below. In this connection it is to be noted that while there are known a variety of rotary piercing processes, such as Mannesmann plug mill line, Mannesmann assel mill line, Mannesmann mandrel mill line, Mannesmann pilger mill line, and Mannesmann multistand pipe mill line, the first stage of operation, namely, rotary piercing is common to all the processes.

FIGS. 7, 8 and 9 are views showing the mode of rotary piercing operation by conventional rotary piercer in plan, in side elevation, and in end elevation on the hollow-shell outlet side respectively. Rolls 71 and 71' each has a barrel shape such that its middle portion is largest in diameter and the diameter of that portion is larger than the length of the barrel, its face angle $\alpha$ being $2° \sim 4°$ on the inlet and outlet sides. The rolls 71, 71' are crosswise arranged in such manner that their axes are parallel to a vertical plane including the center of the pass line along which a billet 73 moves while being rotary-pierced until it is turned out into a hollow shell 78, or in other words, the roll axes and pass line are in parallel relation in plan as shown in FIG. 7 and that each has feed angle $\beta = 6° \sim 12°$ (an angle which the roll axis makes with a horizontal plane including the center of the pass line) relative to the horizontal plane and directed opposite from the other. Further, as can be seen from FIG. 9 (but not from FIG. 7), between the rolls 71 and 71' there are disposed guide shoes 72, 72' in abutment relation to the outer peripheral surface of hollow shell 78 on top and bottom sides for controlling the upper and lower positions of the hollow shell 78 being progressively rotary-pierced as such.

A plug 74, supported by a mandrel 75 extending from the outlet end for hollow shell 78, has its front end positioned beyond the narrowest portion of the roll gap between rolls 71 and 71', where gorges (maximum roll-diameter portions namely minimum roll-gap portions) are positioned in opposed relation, and a little way toward the inlet end for billet 73.

When billet 73, heated to the prescribed temperature, is fed to the rotary piercer, it is driven into the roll gap between the rolls 71 and 71', which are in rotation in same direction as indicated by the arrows in FIG. 7, for rotation in the opposite direction relative to the rolls 71, 71'. The presence of an feed angle $\beta$ allows billet 73 to move forward; meanwhile, billet 73 is repeatedly subject to rotary forging by the rolls 71, 72'. The billet 73, under the rotary forging effect of such rolling, becomes readily centrally pierceable and is then subjected to rotary piercing and diameter expansion by the plug 74. The plug 74 is supported by the mandrel 75, and rotates freely with billet 73 and continues rotary piercing operation without retraction. Thus, billet 73 is subjected to shear deformation due to the interaction of rolls 71, 71' and plug 74 until it is turned into a hollow shell 78.

In the above described process of billet 73 being transformed into a hollow shell 78 by rotary piercing, the billet is subjected to shear deformations in three directions, viz.:

(i) longitudinal shear deformation;

(ii) surfacial shear deformation under torsion; and (iii) circumferential shear deformation.

These modes of shear deformations are schematically illustrated in FIG. 10. Longitudinal shear deformation is a phenomenon that where the billet is assumed to consist of disc-shaped section elements having ends perpendicular to its axis as shown in FIG. 10(*a*), there is caused a metal flow within the billet structure which is characterized in the displacement of boundaries of individual section elements in the longitudinal direction (i.e. toward the billet inlet end of the rotary piercer) as illustrated in FIG. 10(*a'*). Such deformation is inevitable since the billet is subject to longitudinal elongation.

Surfacial shear deformation under torsion is a phenomenon that where the billet is assumed to have a section element parallel to the axis of the billet as shown in FIG. 10(*b*), there is caused a metal flow within the billet structure which deforms such section elements into one of spiral form, as shown in FIG. 10(*b'*). This shear deformation is undesirable because it may lead to development of outside seams (a defect resulting from a seam on the billet surface under surface torsion) on the exterior of finished tube. Circumferential shear deformation is a phenomenon that if the billet has a section element comparable to its diameter as shown in FIG. 10(*c*), there occurs a metal flow which causes displacement in the circumferential direction of the section element on both central and peripheral sides as illustrated in FIG. 10(*c'*). This shear deformation is also undesirable because it may induce formation of inside bore defects in the interior of finished tube.

The reason why surface torsional deformation or circumferential shear deformation, as the case may be, leads to the development of seams and bore on the outer or inner wall surface of the tube is that such deformation, that is, a field under shear stress, if present in the billet, will cause a crack via some inclusion in the billet and such crack will develop into seams or bore defects when the billet is rolled in the field of shear stress.

Such defects result in a decreased yield of acceptable product. Therefore, a rotary piercing method which can minimize or eliminate occurrences of surface torsional deformation and circumferential shear deformation has been much demanded in order to reduce formation of seams and bore defects in finished pipes.

The present inventor has already developed a process for manufacturing seamless steel tubes free of surface torsional deformation (as disclosed in Japanese Patent Publication No. 23473 of 1974). This process is such that where a rotary piercing mill having plate-shaped guide shoes is employed, development of surface torsional deformation and/or circumferential shear deformation as above described can be completely eliminated or substantially minimized by setting feed angle $\beta$ and cross angle $\gamma$ for rolls (cross angle is defined as an angle which the roll axis makes with a vertical plane including the center of the pass line as illustrated in FIG. 11) so as for the angles to meet the following conditions:

$$1{:}5\left(\frac{1}{24}\beta^2+\frac{22}{24}\beta+3\right)^{\circ}>\gamma>3^{\circ}$$

The subject matter of this earlier invention was put in practice by incorporating same into rotary piercing mills in actual operation. The result was that in rotary piercing operation with less workable materials such as Cr—Mo steel, the rate of outside seams occurrence could be remarkably lowered. At same time, it was found that the arrangement could considerably contribute toward decreasing the rate of inside bore defects occurrence.

Even with that method, however, it was found almost impossible to effectively carry out rotary piercing of extremely-hard-to-work materials having very poor hot workability, for example, stainless steels such as austenitic, ferritic, martensitic, and dual phase, and heat- and corrosion-resistant steels such as Inconel and Hastelloy, if production economy is considered. As far as the manufacture of steel tubes of these high-alloy materials is concerned, the state-of-the-art is such that there is no way but employing Ugine-Sejournet process instead of rotary piercing processes which are favorable for mass production. The reason is that the Ugine-Sejournet process hardly involves almost no possibility of surface torsional deformation and/or circumferential shear deformation being caused to the material being worked during tube manufacturing operation; therefore, there is little possibility, if any, that seams and bore defects are formed on the outside and/or inside tube surface. However, in order to carry out operation under Ugine-Sejournet process, it is necessary that a guide hole should be bored through the center of every billet along the entire length thereof by machining in advance. This naturally means increased number of operation steps and decreased efficiency and yield in billet manufacturing. It is inevitable that all these factors by the crust pressure or by the highly increased cost.

Furthermore, as recent developments in the field of steel tube manufacturing, there are two difficult problems, one arising from the material supply side and the other from the steel tube demand side. On the material supply side, the pattern of billet manufacturing is now in rapid transition from a process passing through ingot making and blooming to a process passing through continuous casting. Needless to say, billets manufactured via continuous casting are largely of such type which has center porosity; basically, these billets are not suitable for rotary piercing. On the steel-tube demand side, there is a growing tendency that high-alloy steel tubes are demanded. Referring to oil-well pipes, for example, deeper wells are rapidly increasing in number, which fact means increased load under high-concentration sulphur atmosphere, and accordingly, demand is progressively increasing for pipes of high-alloy steels, such as Incoloy and Hastelloy, which can withstand such severer conditions. As such, the emergence of a novel piercing method which permits mass production of such high-alloy steel tube under a rotary piercing process has been eagerly desired.

OBJECTS OF THE INVENTION

The above is the technical back-ground in which the present invention has been made.

It is therefore an object of the invention to provide a method of piercing which makes it possible to manufacture tubes of less worakable and/or extremely-difficult-to-hot-work high-alloy steels by a rotary piercing process.

It is another object of the invention to provide a method of rotary piercing to obtain hollow shell free of surface torsional deformation and/or circumferential shear deformation from billets of such high-alloy steels and which makes it possible to manufacture high-quality steel tubes free of seams and bores, both outside and inside, at a substantially high yield.

It is a further object of the invention to provide a rotary piercing method which permits manufacture of metal tubes substantially free from exterior scale defects.

It is a still further object of the invention to provide a rotary piercing method which makes it possible to increase the operating efficiency of tube manufacturing facilities.

Other objects and novel features of the invention will be apparent from the following detailed description taken in connection with the accompanying drawings.

DETAILED DESCRIPTION OF THE INVENTION

The characteristic feature of the rotary piercing method of this invention is in the particular type of rotary piercer and feed and cross angles in roll arrangement as selected for rotary piercing operation.

More concretely, the present invention provides a method of rotary piercing in seamless tube manufacturing wherein a heated billet is fed into the roll gap between opposed rolls and subjected, while being moved forward in rotation on its axis and in the axial direction, to center rotary piercing by a plug disposed between the rolls until it is turned into a hollow shell, comprising employing a rotary piercing mill having main rolls disposed in horizontally or vertically opposed relation, with a billet/hollow-shell pass line between, and disc rolls disposed in vertically or horizontally opposed relation between the main rolls, with the pass line between, said main rolls being so arranged as to have a feed angle $\beta$ and cross angle $\gamma$ meeting the following conditions:

$$3° < \beta < 25°$$

$$3° < \gamma < 25°$$

$$15° < \beta + \gamma < 45°,$$

said disc rolls being pressed against the billet and hollow shell during rotary piercing operation.

Incidentally, feed angle $\beta$ is an angle which the axis of each main roll makes with a horizontal plane (where the main rolls are arranged in horizontally opposed relation) or vertical plane (where the main rolls are arranged in vertically opposed relation) including the center of the pass line. Cross angle $\gamma$ is an angle which the main roll axis makes with a vertical plane (where the main rolls are arranged in horizontally opposed relation) or horizontal plane (where the main rolls are arranged in vertically opposed relation) including the center of the pass line.

Figure 1:
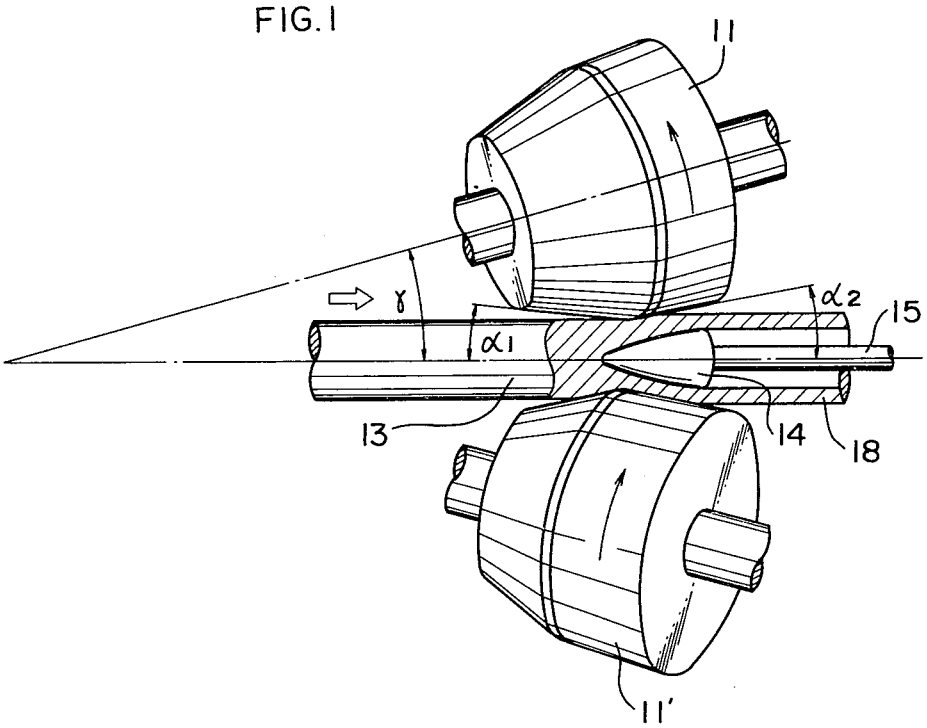
FIG. 1 is a plan view showing a mode of carrying out the method of the invention.
Figure 2:
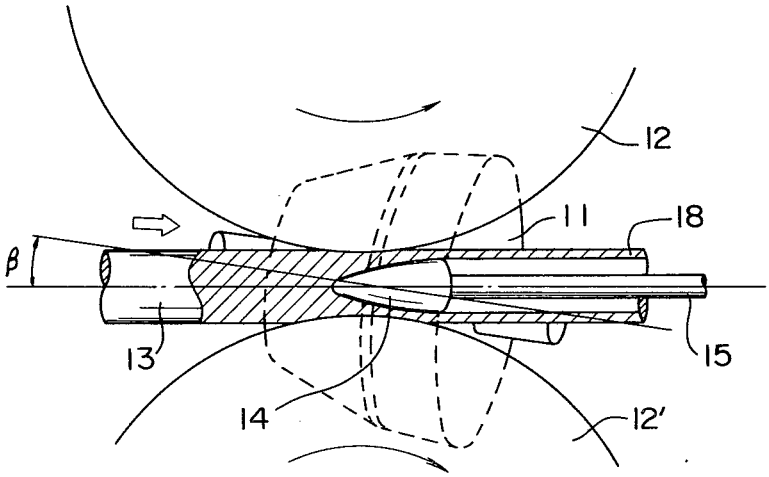
FIG. 2 is a side view showing same.
Figure 3:
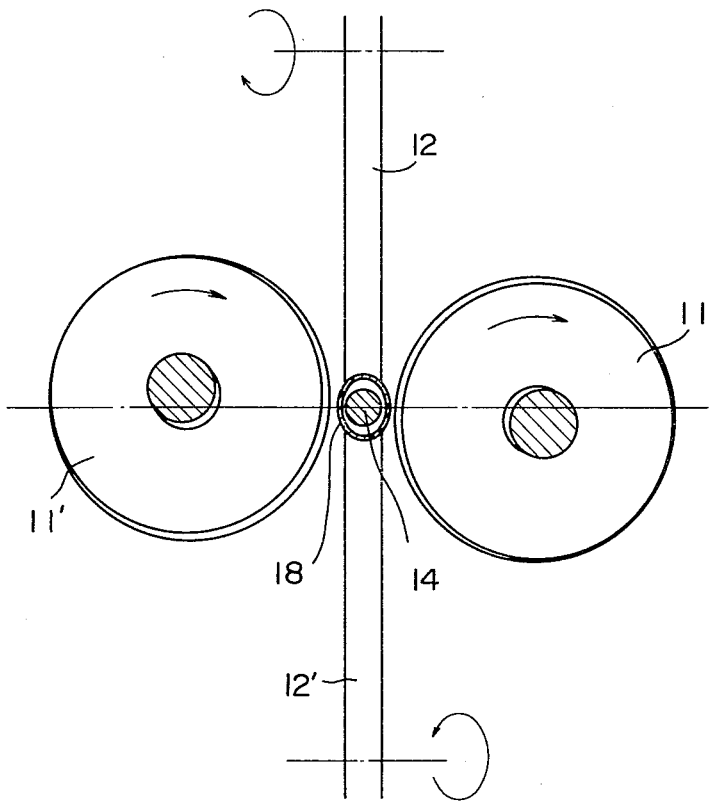
FIG. 3 is an end view of same as seen from the hollow-shell outlet side.

Now, key portions of the rotary piercing mill employed in carrying out the invention will be explained with reference to FIGS. 1 to 4, inclusive. Main rolls 11, 11', disposed in opposed relation on both sides of the pass line, are cone shaped, each having an inlet-side face angle $\alpha_1$ on the inlet (for billet 13) side and an outlet-side face angle $\alpha_2$ on the outlet side, with a gorge formed at the intersection or boundary between the inlet-side roll surface and the outlet-side roll surface. The diameter of each roll is largest at its outlet-side end. The shaft of the roll is supported at both ends thereof by bearings (not shown) provided inside the body of the rotary piercing mill. If roll shafts are supported at one end only, the main rolls are likely to vibrate during rotary piercing operation, which may be a cause of wall eccentricity. Such vibration will also adversely affect the configuration of the hollow shell, both outside and inside. The rolls are arranged in such a way that the prolongations of their axes extend in opposite directions at an equal feed angle $\beta$ relative to a horizontal plane including the center of a pass line which billet 13 passes through, and that said prolongations cross at a symmetrical cross angle $\gamma$ relative to a vertical plane including the center of the pass line. The main rolls are rotated at same peripheral speed in same direction as indicated by the arrows. Between the main rolls 11 and 11', as FIG. 3 shows, there are disposed disc rolls 12, 12' which are adapted to exert pressure to hollow shell 18 from both top side and underside along a line perpendicular to the pass line. The outside diameter of each disc roll 12, 12° is about 2~3 times as large as the maximum diameter of each main roll 11, 11'. This disc rolls, powered by a drive motor separate from that for the main rolls, are rotated in such direction that they force billet 13 toward the gorge. Their rotation speed is determined relatively to sin $\beta$. Feed angle $\beta$ varies depending upon the billet to be pierced; and sin $\beta$ or sine of feed angle $\beta$ determines the forward drive force to be applied to billet or hollow shell or the speed of travel thereof in the axial direction. Therefore, it is reasonable to determine the peripheral speed or rotation speed of the disc rolls 12, 12' relatively to sin $\beta$ so that it is related to the travel speed of the billet or hollow shell. Concretely, with the change of sin $\beta$, the peripheral speed of the disc rolls may be varied proportionally to D·sin $\beta$ (where D is gorge diameter). There is provided a piercing plug 14 with its front end positioned at a location slightly spaced apart from the gorge toward the inlet for billet 13, the plug being supported at its rear end by a mandrel 15.

In the present invention, the scope of feed angle $\beta$ and cross angle $\gamma$ is limited as above mentioned so as to conform to actual rotary piercing conditions. Generally, the larger the feed and cross angles $\beta$ and $\gamma$, the greater their effect for prevention of circumferential shear deformation. Naturally, however, these angles have their upper limits by reason of the mechanical limitations inherent in rotary piercer designing. If angle setting is in excess of 25°, bearings for supporting the roll shafts cannot be accommodated in the body of the rotary piercing mill, which fact makes it impracticable to maintain the both-end support design for the rolls. Further, the joint between the roll shaft and the spindle which transmits drive force to the roll would mechanically interfere with the hollow shell. From the standpoint of mechanical designing, therefore, it is almost impossible to have a higher upper limit of angle setting.

The lower angle limit of 3° is defined in relation to piercing ratio. As the parameter indicating the degree of working by rotary piercer, piercing ratio is defined as the ratio of hollow-shell length to billet length. The greater the piercing ratio, the thinner the hollow-shell wall. Therefore, a greater piercing ratio means that the material is subjected to severer working, which is more likely to lead to bore defects formation on the interior surface. For this reason, piercing ratio is generally set within the range of 1.5 to 4.5. In order to achieve a piercing ratio within such range, the lower limit of angles $\beta$ and $\gamma$ is set at 3°.

Referring to the value range for $\beta+\gamma$, it is noted that if the value is lower than 15°, formation of inside bore defects would be inevitable; moreover, billet feed speed would be lowered, with the result of decreased production efficiency. If it exceeds 45°, there would be increased interference of hollow shell with the spindle and roll-shaft coupling and thus satisfactory rotary piercing operation would be prevented. For these reasons, the selectable range for $\beta+\gamma$ is established to be 15°~45°.

Figure 4:
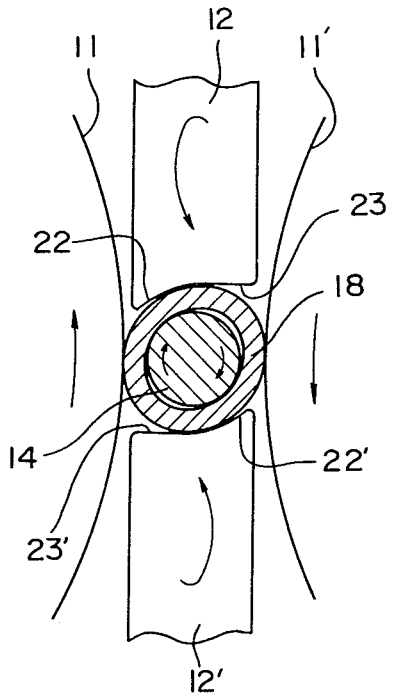
FIG. 4 is an end view of same as seen from the billet inlet side.

The present invention is effective particularly for preventing inside bore defects formation due to circumferential shear deformation. This is largely attributable to the use of disc rolls 12, 12'. As shown in FIGS. 2, 3 and 4, the disc rolls 12, 12' are disposed between the main rolls 11 and 11' in such manner that they press billet 13 and hollow shell 18 from top side and underside, being rotated in the direction of arrows 20, 21 so as to force billet 13 toward the outlet side from the inlet side. FIG. 4 is a fragmentary sectional view of the arrangement cut away perpendicularly to the pass line substantially centrally of plug 14 in the longitudinal direction, as seen from the inlet side. As can be seen from the figure, the disc rolls 12, 12', on their roll faces, have edge portions which are unsymmetrical. On the edge portions opposed at a location where waste metal from hollow shell 18 is extruded out of the gap between the main rolls 11, 11' and the plug 14 in the peripheral direction as rolling progresses following rotation of the main rolls and plug, there are formed projection surfaces 22, 22', while on the edge portions opposed at a location where such waste metal is drawn into the gap between the main rolls 11, 11', and the plug 14, there are formed escape surfaces 23, 23'. In other words, the periphery of disc rolls 12, 12' each is diametrically reduced in the direction of rotation of the hollow shell.

In conventional method of rotary piercing, plate-shaped guide shoes are provided between main rolls. Each guide shoe is apt to press with its surface waste metal from the hollow shell as it comes out in swelled state. Since the guide shoes are fixed to the rotary piercer, it is likely that as the hollow shell travels in the longitudinal direction it is rubbed against the guide shoe surfaces. The frictional resistance during such rubbing tends to encourage development of circumferential shear deformation. Where, as in the method of the invention, pressure is exerted on the hollow shell 18 by forcibly rotated disc rolls 12, 12', the frictional force against the thrust applied in the direction of movement of the hollow shell is naturally diminished; and accordingly substantially same metal flow as in the case where Ugine-Sejournet extrusion process is employed can be obtained.

To further illustrate this invention, the following examples are given.

EXAMPLE 1

| | |
|---|---|
| Main rolls: | |
| Maximal diameter | 350 mm |
| Rotation speed | 60 r.p.m. |
| $\beta$ | 8 steps variable, from 6° to 20° |
| $\gamma$ | 5 steps variable, from 0° to 20° |
| Disc rolls: | |
| Diameter | 900 mm |
| Rotation speed | follow-up variable proportionally to D·sin$\beta$ (3.3 r.p.m. ~ 9.9 r.p.m.) |
| Plug: | |
| Diameter | 50 mm |
| Test billets: | |
| Material | carbon steel (C = 0.50%) |
| Dia. | 70 mm and 72 mm |
| The billets to be pierced into hollow shells of 70 mm ~ 71 mm dia. | |

Rotary piercing was carried out under these conditions. The effects of feed angle $\beta$ and cross angle $\gamma$ on circumferential shear deformation $\gamma_{r\theta}$ were examined. The results are presented in FIG. 5. Circumferential shear deformation $\gamma_{r\theta}$ is expressed by the following relation:

$$\gamma_{r\theta} = \frac{r \cdot \theta}{t}$$

where r: outer radius of hollow shell t: wall thickness of hollow shell $\theta$: displacement angle expressed in terms of radian.

Circumferential shear deformation $\gamma_{r\theta}$ was measured in the following manner: pins were embeded in each billet in sections thereof at certain intervals in the radial direction, and locations of the pins were observed after rotary piercing operation.

Figure 5:
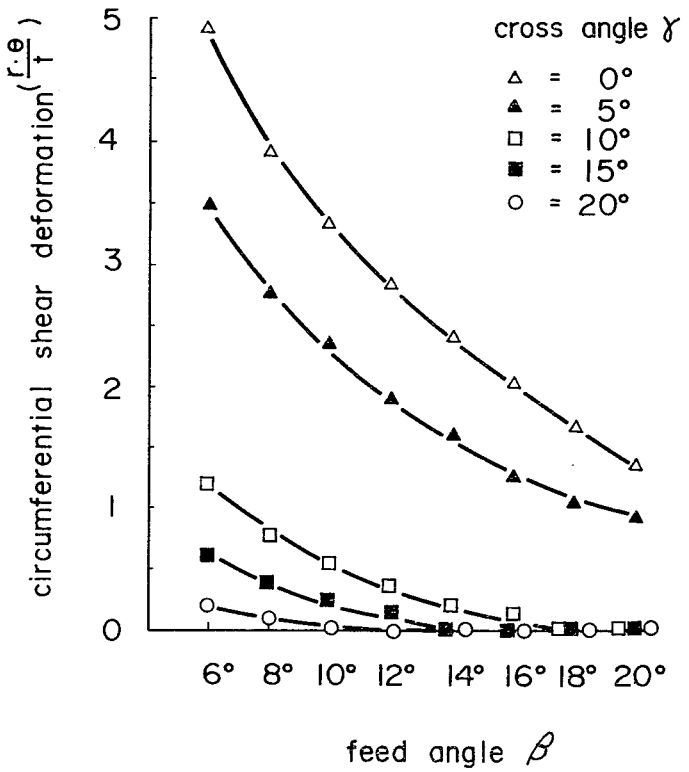
FIG. 5 is a graph showing the effects of feed and cross angles on circumferential shear deformation possibilities.

As FIG. 5 shows, it is apparent that the feed angles $\beta$ have noticeable effects upon circumferential shear deformation $\gamma_{r\theta}$. In proportion as the feed angle becomes larger, there is a remarkable decrease in the value of circumferential shear deformation $\gamma_{r\theta}$. Similarly, circumferential shear deformation $\gamma_{r\theta}$ decreases significantly with the decrease in cross angle $\gamma$. It is particularly noticeable that where feed angle $\beta \geqq 14°$ against cross angle $\gamma = 15°$, or where feed angle $\beta \geqq 10°$ against cross angle $\gamma = 20°$, circumferential shear deformation is completely eliminated, showing $\gamma_{r\theta} = 0$. Thus, substantially same metal flow as in the case of Ugine-Sejournet process being employed was obtained.

EXAMPLE 2

The effect of feed angle $\beta$ and cross angle $\gamma$ on internal inside bore defects formation on hollow shell when the rotary piercing method of the present invention is employed was examined. Rotary piercing conditions were same as those in Example 1. Used as test material was Nb-added austenitic stainless steel (Cr: 17~20%, Ni: 9~13%, Nb: 1%, the rest substantially Fe), a stainless steel which is recognized as having most poor hot workability. Experience with this material had been such that when it is used to produce hollow shell under conventional Mannesmann rotary piercing method, there usually occur noticeable bore defects on the inside surface, and to be worse, there are often cases where the wall of the hollow shell is broken so that bore defects extend to outer wall surface.

Figure 6:
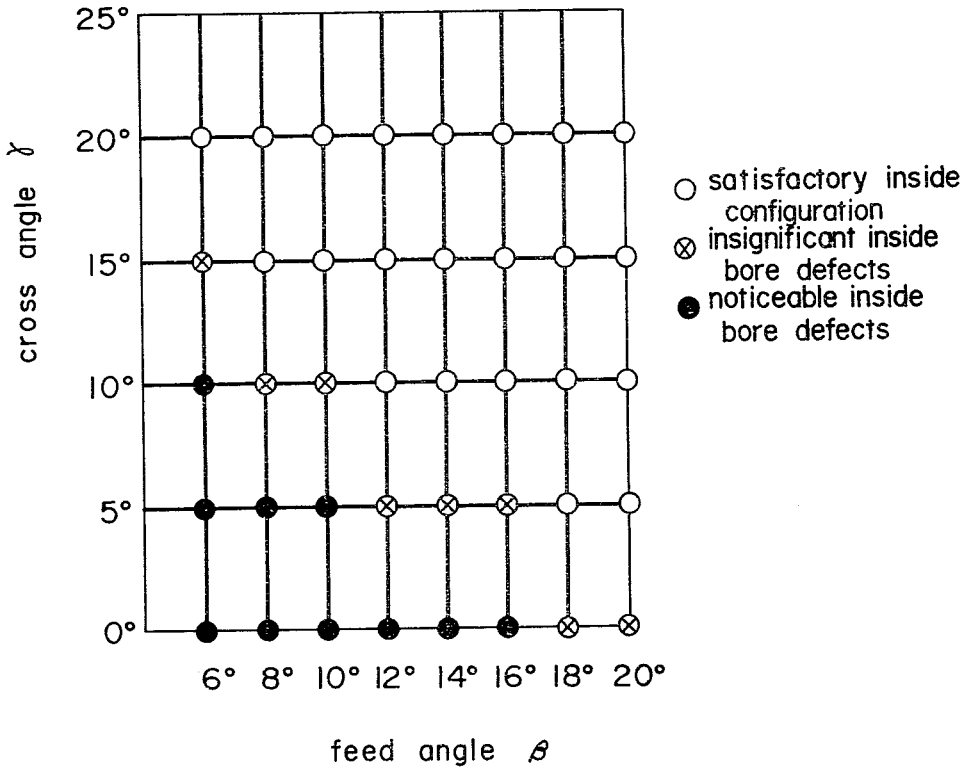
FIG. 6 is a graph showing the effects of feed and cross angles on formation of bore defects on the inside steel-tube surface.
Figure 7:
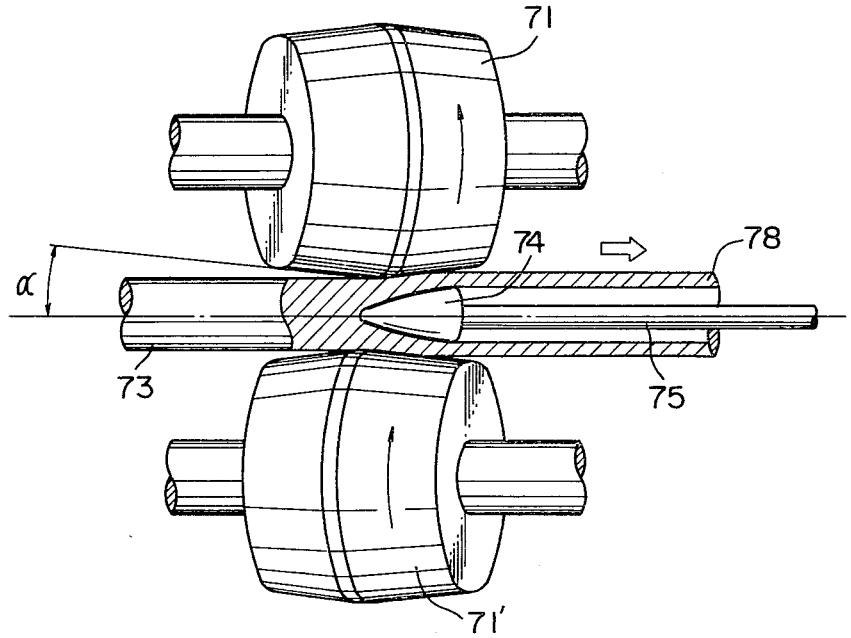
FIG. 7 is a plan view showing conventional mode of rotary piercing operation.
Figure 8:
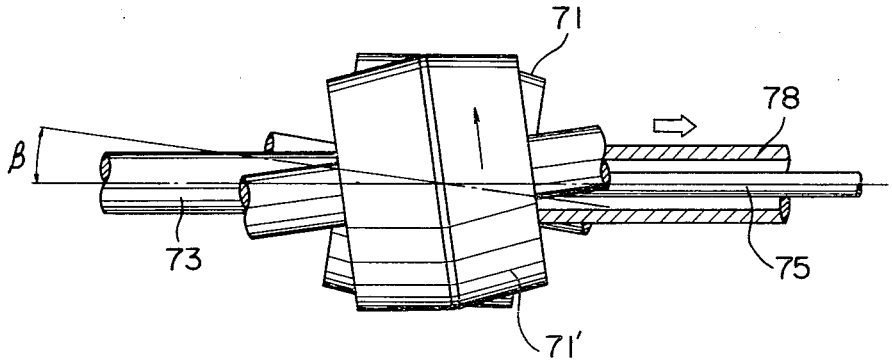
FIG. 8 is a side view of same.
Figure 9:
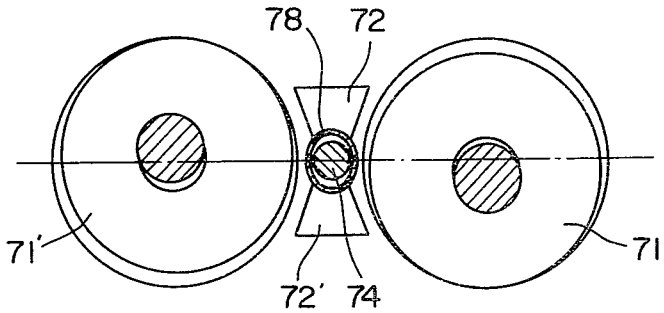
FIG. 9 is an end view of same seen from the hollow-shell outlet side.
Figure 10:
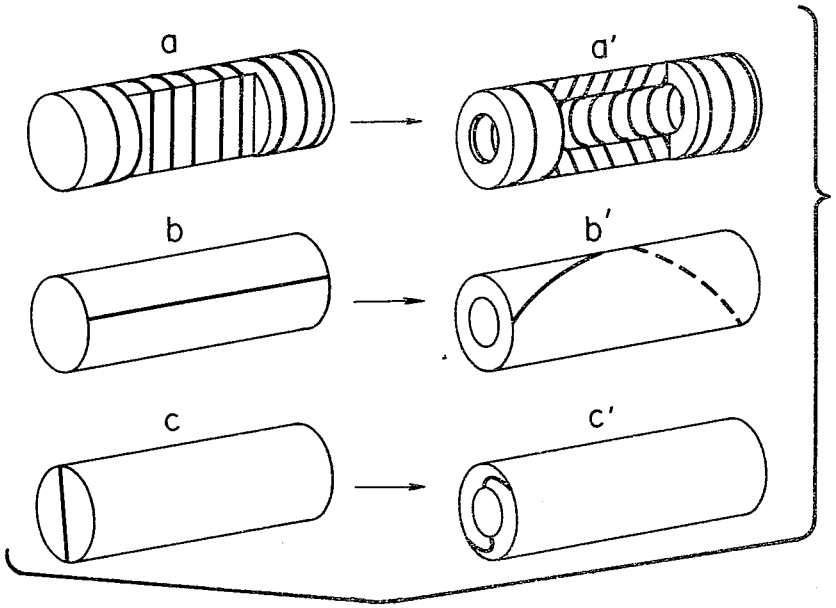
FIG. 10 is an explanatory view showing various types of shear deformation.
Figure 11:
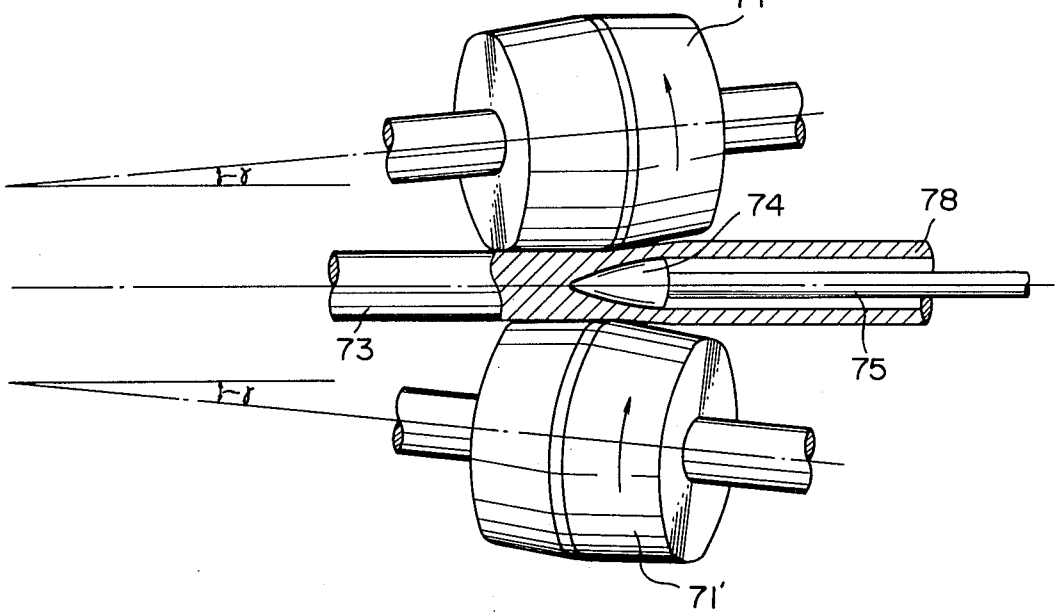
FIG. 11 is a plan view for explanation of cross-angle setting.

Test results are shown in FIG. 6, wherein mark ● denotes inside bore defects noticeable, ◑ denotes insignificant inside bore defects, and o denotes satisfactory inside configuration. As can be readily understood from the graphical representation, feed angle $\beta$ and cross angle $\gamma$ have remarkable effects. Inside bore defects decrease remarkably in proportion as feed angle $\beta$ and cross angle $\gamma$ increase. It is significant to note that changes in the magnitude of inside bore defects correspond to those in the magnitude of circumferential shear deformation as shown in FIG. 5. Apparently, there is a significant relation between circumferential shear deformation and inside bore defects.

EXAMPLE 3

Extremely-hard-to-work materials were subjected to rotary piercing by the method of the invention and by conventional method (three conditions), under same conditions. The resulting hollow shells were manufactured into finished tubes. Inspection yields were compared. Compositions of test materials are shown in Table 1.

TABLE 1

| | | Cr | Ni | Mo | W | Nb | Fe & impurities |
|---|---|---|---|---|---|---|---|
| A | Cr—Mo steel | 9 | — | 1 | — | — | rest |
| B | Dual phase stainless steel | 25 | 7 | 3 | 1 | — | rest |
| C | Austenitic stainless steel | 18 | 10 | — | — | 1 | rest |
| D | High Cr—Ni—Mo steel | 25 | 50 | 6 | — | — | rest |
| E | Hastelloy C | 15 | 60 | 16 | 4 | — | rest |

(In weight %)

Rotary piercing conditions were as follows:

| | |
|---|---|
| (1) billet dia.: | 72 mm$^{\phi}$ |
| (2) piercing ratio: | 2.7 |
| (3) expansion ratio: | 3% |
| (4) piercing temperature: | 1200° C. |

Inspection results are presented in Table 2.

TABLE 2

| Steel | Inspection yield (%) Conventional I Feed angle 10° Cross angle 0° Guide shoe | Conventional II Feed angle 15° Cross angle 0° Disc roll | Conventional III Feed angle 15° Cross angle 20° Guide shoe | Invention Feed angle 20° Cross angle 20° Disc roll |
|---|---|---|---|---|
| A | 90 | 95 | 95 | 100 |
| B | 55 | 65 | 85 | 100 |
| C | 30 | 55 | 75 | 95 |
| D | 15 | 35 | 65 | 90 |
| E | — | 15 | 50 | 90 |

Generally, steels with higher Cr and Ni contents showed greater tendency toward poorer hot workability, resulting in increased seams and bore defects, both outside and inside, and decreased inspection yield. However, products manufactured in accordance with the method of the invention showed very satisfactory inspection results, 100% or substantially similar yields, regardless of the type of steel material used. When the results are examined with particular emphasis on the degree of improvement, greater improvements in yield are seen with materials which inherently have poorer hot workability. This tells that the method of the invention is more effective when employed in rotary piercing steels having poorer hot workability.

In the present invention, the improvement in inspection yield as seen above is of course largely attributable to substantial elimination of the inside bore defects, and outside seams, consequent on the substantial reduction of surface torsional deformation as well as circumferential shear deformation. Another reason for such yield improvement is that development of scale defects on the outer surface is substantially prevented. In conventional rotary piercing methods employing guide shoes, or those employing disc rolls of such type that the roll faces have edge portions forming symmetrical calibers, scales falling from the billet or hollow shell during rotary piercing operation deposit on guide shoe or disc roll shoe face as such and they become attached to the surface of the billet or hollow shell and are formed into scale defects in the course of rolling operations. In this invention, however, the disc rolls, on their roll faces, have edge portions formed as escape ways along the direction of rotation of billet or hollow shell so that scales are prevented from depositing on the roll face; therefore, there is no little (if any) possibility of scale defect occurrence.

The method of the present invention is advantageous also from the standpoint of operating efficieny. In conventional method using plate-shaped guide shoes, it is often required that guide shoes should be replaced even during rotary piercing operation because they are subject to severe wear. For this reason, there are often cases where rotary piercing operation must be suspended for replacement of shoes; naturally, this results in decreased operating efficiency of the entire tube-manufacturing equipment. In the present invention, the possibility of disc-roll-face wear is substantially reduced, and there is little or no necessity of suspending rotary piercing operation for replacement; all this naturally leads to improved operating efficiency.

As already described, the method of the invention is such that cone-shaped main rolls, supported at both shaft ends, are set at large feed and cross angles, with disc rolls best utilized for forcing billet into position while preventing development of wall eccentricity during rotary piercing operation, whereby both surface torsional deformation may be completely eliminated or minimized as if Ugine-Sejournet extrusion process were employed. Further, the method makes it possible to carry out rotary piercing of extremely-difficult-to-work steels which have been regarded as imcompatible with rotary piercing on a commercial production basis, without causing inside bore defects and outside seams or with the least possible occurrence of such defects. Therefore, it may be said that the invention will go a long way toward rationalization of steel tube manufacturing process and much desired improvement of yield. It may be counted as a novel and much meaningful method of rotary piercing in steel tube manufacturing.

In the above detailed description, the main rolls are horizontally arranged, left and right, with the pass line therebetween, and the disc rolls are vertically disposed, upside and underside. Of course, it is possible that the main rolls are vertically arranged, with the pass line therebetween, and the disc rolls are horizontally disposed. In either case, physical effect of the arrangement is exactly same.

As this invention may be embodied in several forms without departing from the spirit of essential characteristics thereof, the present embodiment is therefore illustrative and not restrictive, since the scope of the invention is defined by the apended claims rather than by the description preceding them, and all changes that fall within meets and bounds of the claims, or equivalence of such meets and bounds are therefore intended to be embraced by the claims.

What is claimed is:

1. A method of rotary piercing in seamless tube manufacturing wherein a heated billet is fed into the roll gap between opposed rolls and subjected, while being moved forward in rotation on its axis and in the axial direction, to center rotary piercing by a plug disposed between the rolls until it is turned into a hollow shell, comprising employing a rotary piercing mill having main rolls disposed in horizontally or vertically opposed relation, with a billet/hollow-shell pass line between, and rotating disc rolls disposed in vertically or horizontally opposed relation between the main rolls, with the pass line between, said main rolls being so arranged as to have a feed angle $\beta$ and cross angle $\gamma$ meeting the following conditions:

$$3° < \beta < 25°$$

$$3° < \gamma < 25°$$

$$15° < \beta + \gamma < 45°,$$

said rotating disc rolls being pressed against the billet and hollow-shell during the rotary piercing operation to produce a hollow shell with substantially reduced circumferential shear deformation and internal bore defects.

2. A method of rotary piercing as set forth in claim 1, wherein said disc rolls are rotated by a drive motor separate from that for the main rolls so as to assist in billet engagemet with the main rolls.

3. A method of rotary piercing as set forth in claim 1 or 2, wherein the rotation speed of said disc rolls are determined in relation to sin $\beta$.

4. A method of rotary piercing as set forth in claim 1, wherein the outside diameter of said disc rolls each is greater than the maximal outside diameter of each of the main rolls.

5. A method according to claim 1 wherein said main rolls are generally conical.

6. Apparatus for rotary piercing in seamless tube manufacturing comprising:

a pair of opposed main rolls defining a roll gap into which a heated billet is fed while being moved forward in rotation on its axis and in the axial direction, said main rolls disposed in horizontally or vertically opposed relation, with a billet/hollow-shell pass line between, a plug disposed between the rolls to pierce the heated billet until it is turned into a hollow shell; and rotatable disc rolls disposed in vertically or horizontally opposed relation between the main rolls, with the pass line between, said main rolls being so arranged as to have a feed angle $\beta$ and cross angle $\gamma$ meeting the following conditions:

$$3° < \beta < 25°$$

$$3° < \gamma < 25°$$

$$15° < \beta + \gamma < 45°,$$

said disc rolls being pressed against the billet and hollow-shell during the rotary piercing operation to produce a hollow shell with substantially reduced circumferential shear deformation and internal bore defects.

7. Apparatus as set forth in claim 6, further comprising a drive motor separate from the main rolls for rotating said disc rolls and to assist in billet engagement with the main rolls.

8. Apparatus as set forth in claim 7 wherein the speed of rotation of said disc rolls is proportioned to sin B.

9. Apparatus as set forth in claim 8 wherein said drive motor for said disc rolls rotates said disc rolls at a speed which is proportioned to sin $\beta$.

10. Apparatus as in claim 6 wherein the outside diameter of said disc rolls is greater than the maximum diameter of said main rolls.

11. Apparatus as in claim 6 wherein said main rolls are generally conical.

* * * * *